United States Patent [19]

Leslie et al.

[11] 4,253,368

[45] Mar. 3, 1981

[54] UNIVERSAL PULSATO UNIT

[75] Inventors: Donald J. Leslie, Altadena; Paul H. Sharp, South Pasadena, both of Calif.

[73] Assignee: Marmon Company, Chicago, Ill.

[21] Appl. No.: 701,638

[22] Filed: Jul. 1, 1976

[51] Int. Cl.[3] ..... G10H 1/02; G10H 1/04; G10K 7/00; G10K 13/00

[52] U.S. Cl. ..... 84/1.24; 84/1.25; 181/143; 181/171

[58] Field of Search ..... 179/1 J; 181/143, 171; 84/1.25, 1.24; 74/661

[56] References Cited

U.S. PATENT DOCUMENTS

| | | | |
|---|---|---|---|
| 1,445,508 | 2/1923 | Hahnemann et al. | 181/171 |
| 1,788,105 | 1/1931 | High | 181/171 |
| 3,157,247 | 11/1964 | Ishimura | 181/143 |
| 3,245,284 | 1/1966 | Leslie | 74/661 |
| 3,315,760 | 4/1967 | Schwendener | 181/143 |
| 3,902,015 | 8/1975 | Edwards et al. | 179/1 J |

*Primary Examiner*—Vit W. Miska

*Attorney, Agent, or Firm*—Neuman, Williams, Anderson & Olson

[57] ABSTRACT

An improved mounting for an acoustic pulsato rotor for suppression of spurious sounds utilizes a spring bias for axial thrust between the shaft ends and bearing cups. In one form, a plurality of thin spider legs extend from a rotor mounting panel in surrounding relationship to the rotor to provide the spring characteristics while being acoustically transparent to the sound radiation pattern that sweeps past. The spider legs have a quick fit, anti-noise twist lock connection to a central hub. Improved rubber-like grommets provide anti-shock and anti-noise mounting for the shaft. Improved rubber-like grommets in cooperation with a two part motor mounting provide anti-shock and anti-noise motor mounting without sacrifice of simple belt tension adjustment capability. A light weight back enclosure for the speaker acquires sound isolation characteristics of a sturdy structure by imposing stress on the enclosure.

18 Claims, 8 Drawing Figures

UNIVERSAL PULSATO UNIT

FIELD OF INVENTION

This invention relates to musical instruments, and more particularly to pulsato rotors of the type shown and described in U.S. Pat. No. 3,315,760 to Jacob M. Schwendener issued Apr. 25, 1967 and entitled ACOUSTIC DAMPING DRIVE FOR PULSATO ROTOR. Such pulsato rotors form an acoustic link between the speaker output of an electrical musical instrument and the room or space in which the sounds are perceived by the listeners. The operative element of the pulsato rotor is a rotary sound channel whereby the sound radiation pattern is rotated to impart the desired pulsato or phase shift effects.

BACKGROUND OF THE INVENTION

Pulsato rotors of the general type shown in Schwendener's patent have been used extensively. There are two basic modes of use. In the so-called free standing organization illustrated in the Schwendener patent, the pulsato rotor is mounted between spaced panels or partitions in a speaker cabinet. A speaker is mounted on one panel in line with the rotor axis but on the opposite panel side. The speaker registers via a large opening with the throat of the sound channel. In the so-called built-in organization illustrated in U.S. Pat. No. 3,245,284 to Donald J. Leslie issued Apr. 12, 1966 and entitled ROTOR DRIVE FOR PULSATO APPARATUS, the pulsator rotor is mounted on one side of a single panel or board while the speaker is mounted on the other side. In order to provide outboard support for the pulsato rotor, a generally U-shaped yoke or bracket is mounted on the panel. The panel together with the pulsato rotor and speaker is typically then mounted by an organ manufacturer in the console. The organ manufacturer is ordinarily responsible for back enclosure of the speaker so that the pulsato effects are not diluted by back radiation.

In addition to the problem of proper back enclosure of the speaker for full strength production of pulso, there have been certain noise problems in the pulsato unit of this general type. One noise is a flutter effect due to the rather substantial width of the yoke or bracket. Thus the yoke or bracket serves as a baffle or reflector that imposes a certain acoustic impedance that recurs twice every revolution. A slight, but objectionable flutter or buffeting takes place.

Another problem is the propogation and mechanical amplification of shaft and bearing noises that are most noticeable at low speeds and during speed changes of the rotor. Noises due to belt slippage and lateral movement are controlled by adjustment of the motor bracket and possible replacement of the pulley belt. In the past, a complex noise isolation pivoted motor bracket arrangement was provided that was not always stable in certain panel orientations.

The primary object of the present invention is to provide a simplified pulsato rotor that not only has improved musical characteristics in terms of noise reduction, flutter elimination and back speaker radiation, but which also has improved mechanical characteristics in terms of low weight, ease of assembly, standardization of parts, reduction in number of parts, and ease of pulley adjustment.

SUMMARY OF INVENTION

In order to accomplish the foregoing object, we provide a new shaft and bearing assembly in which the shaft ends are, with a positive bias, caused to engage the thrust bearing surfaces of the bearings. Rattling and squeaking is largely eliminated. In the built-in organization, three identical angled rods quick fitted to an outboard hub serve to support a cup like shaft bearing through the intermediary of a noise reduction neoprene grommet. An identical bearing and grommet arrangement is provided at the inboard end which is supported by a simple strap that spans the port between the speaker and rotor throat. By utilizing the spring characteristics of the angled rods, a controlled end thrust is imposed upon the shaft. In the free standing organization, the identical bearing and grommet assembly is used at both panels or partitions, but since the panels themselves are in fixed spaced relationship, the shaft itself is multipart with an internal spring that serves not only to allow for variations in the spacing of the panels, but also provide the necesary positive bias to ensure a positive contacı between the shaft ends and the thrust bearing surfaces.

The outboard hub supporting rods are quite narrow and hence impose very minimal acoustic impedance whereby the flutter or buffeting effect is minimized.

In order to minimize transmission of pulley belt noises, a simplified motor mounting bracket is provided in which biconical acoustic damping pads mount the motor on a rectilinearly movable adjustment bracket. During normal operation, the motor weight is supported with very minimum contact at the apices of the biconical pads in order to minimize noise transmission to the panel. The conical configuration provides a spring constant that increases as a function of displacement whereby adequate shock support is provided notwithstanding the minimal contact during normal operation. The pads are interposed between an adjustment bracket and the motor rather than between the adjustment bracket and the panel. Parallel slots in the adjustment bracket make possible simple belt tension adjustment that is stable in all orientations of the panel.

In order to provide an efficient back enclosure for the speaker, we provide a molded expanded polystyrene cap that adds very little weight. The lightweight and flexible characteristics of the polystyrene would ordinarily be expected to result in buzzes and rattles as well as reradiation of sound. However, by imposing a compressive load upon the cap, the cap acts as a massive and rigid body quite equivalent to a heavy enclosure. The compressive load is readily imposed by a plate attached to the rear of the speaker magnet.

BRIEF DESCRIPTION OF DRAWINGS

A detailed description of the invention will be made with reference to the accompanying drawings wherein like numerals designate corresponding parts in the several figures. These drawings, unless described as diagrammatic or unless otherwise indicated, are to scale.

DETAILED DESCRIPTION OF PREFERRED EMBODIMENT

The following detailed description is of the best presently contemplated modes of carrying out the invention. This description is not to be taken in a limiting sense, but is made merely for purposes of illustrating the general principles of the invention since the scope of the invention is best defined by the appended claims.

Structural and operational characteristics attributed to forms of the invention first described shall also be attributed to forms later described, unless such characteristics are obviously inapplicable or unless specific exception is made.

Figure 1:
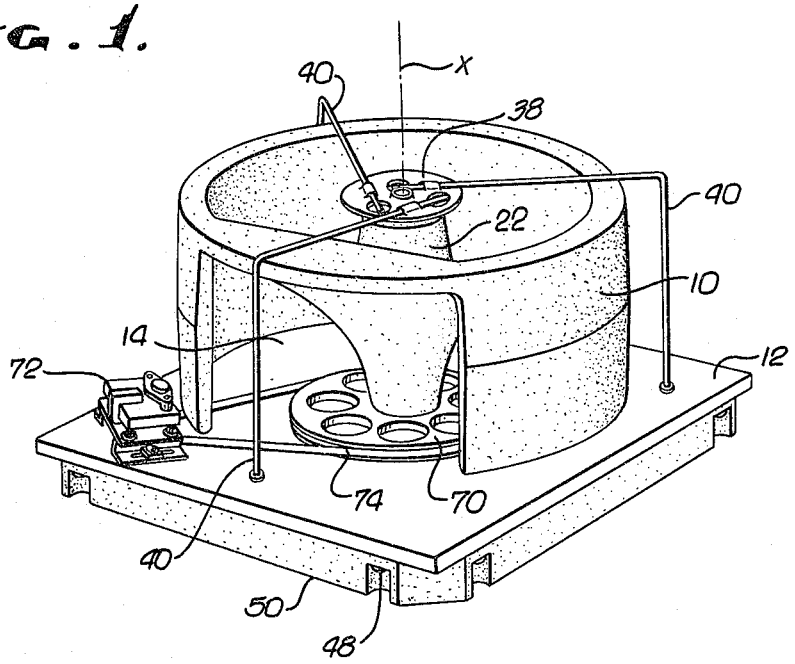
FIG. 1 is a pictorial view of a pulsato unit incorporating the present invention.

In FIG. 1 there is illustrated a pulsato rotor 10 mounted on one side of a panel or board 12 for rotation about an axis x perpendicular to the panel 12. A speaker (FIG. 3) is coaxially mounted on the other side of the panel. The rotor 10 has an angled sound channel 14 having a throat end registering via a panel opening 16 with the speaker and a laterally opening mouth to provide a rotating sound radiation all in a well understood manner.

The rotor 10 is made of light weight molded expanded polystyrene dynamically balanced to provide stable rotating characteristics. The light weight construction minimizes inertia for rapid speed changes as required by the musician.

The rotor is supported for rotation upon a one piece shaft 18 by the aid of a pair of apertured neoprene grommets 20. The grommets are attached at opposite ends of the central hub 22 of the rotor. These grommets are tapered or frusto-conical at the inner ends to fit correspondingly tapered recesses 24 in the rotor hub.

The grommets 20 are preferably cemented in place all in the absence of any compressive load upon the grommets. The grommets provide high acoustic impedance to limit transmission of noises to the rotor and at the same time provide suitable shock mounting for the rotor. Washers 26 locate the rotor on the shaft.

The shaft ends project beyond the rotor and are received in low friction plastic bearing cups 28 which have tapered seats for the rounded ends of the shafts. The bearing cups 28 in turn are mounted in neoprene supporting grommets 30. The rotor is supported simply by providing mounting holes in supporting brackets for the bearing grommets 30. One hole 32 is provided in a strap or plate 34 that extends diagonally across the panel opening 16. Another hole 36 is provided in a hub plate 38 at the outboard end of the shaft.

The hub plate is supported by the aid of three spider legs 40 that form a cage about the rotor. Each of the spider legs comprises a light rod bent at its center to provide an angularity of slightly less than 90°. Each spider leg is stamped near both ends to provide a lug 42 located in the plane determined by the rod bend. The lug 42 at one end serves to attach the spider leg to the panel 12 while the lug 42 at the other serves to attach the spider leg to the hub plate. The spider legs are symmetrical for simplification of assembly.

Each spider leg is attached to the panel 12 by the aid of a stop washer 44 and a speed nut 46. A recessed attachment pad 48 (FIG. 3) of a speaker cover 50 as well as a soft paper gasket 52 are interposed between the panel and the speed nut whereby the cover 50 is mounted. The cover 50 will be described more fully hereinafter.

Figure 2:
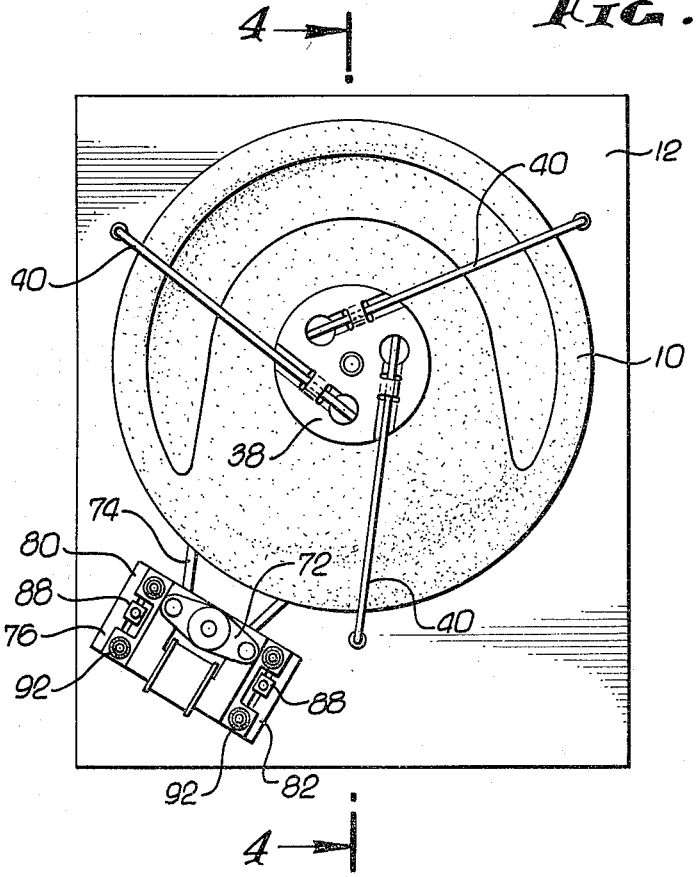
FIG. 2 is a plan view thereof from the rotor side of the mounting panel.
Figure 5:
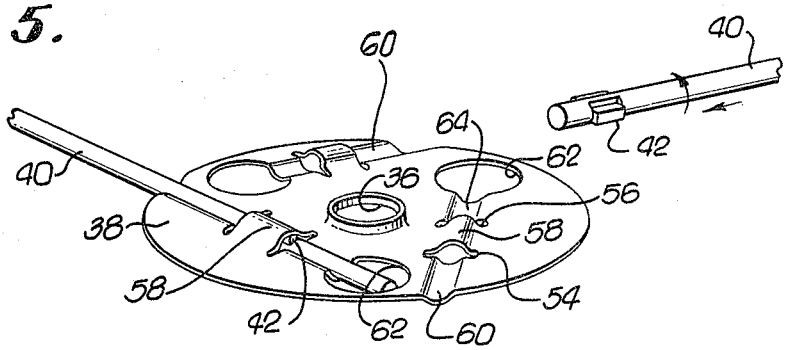
FIG. 5 is a diagrammatic view illustrating the assembly of one of the supporting spider legs with the hub plate.

The outboard end of each of the spider leg extends skew to the rotor axis x (FIG. 2) to form with the companion spider legs a generally triangular array about the mounting hole 36. The hub plate is lanced and stamped (FIG. 5) to provide three knuckle strap attachments for the three spider legs. The three attachments are identically formed but located in angularly spaced array. One of the attachments, for example, is formed in part by two spaced parallel cuts 54 and 56 defining therebetween a strap 58 that is bowed laterally of the hub plate in one direction. Another part is formed by stamping the hub plate between the outer cut 54 and the edge of the plate to form a lateral arcuate depression 60 in the opposite direction. The third part of the knuckle strap attachment is formed by stamping between the inner cut 56 and a hole 62 to form an arcuate depression 64 extending in the same direction as the outer depression 60. The spider leg is inserted into the attachment from the outer edge, passing under the strap 58 and across the hole 62 until it abuts the edge of the hole. By turning the spider leg, its lug 42 wedges against the strap 58 until the leg is slightly bowed by the interaction. An exceedingly tight, rattle free joint is achieved notwithstanding the simple quick fit connection. The preassembled three spider legs and the hub plate 38 are readily attached to the mounting board over the preassembled rotor, bearings 28 and grommets 30. The bearing grommets 30, in combination with the rotor grommets provide noise isolation as well as shock protection.

The length of the rotor shaft is so designed that, in the assembled position, the hub plate flexes the spider legs outwardly. A positive spring interaction is thereby generated to impose a controlled end thrust upon the shaft bearings. Squeaks, rattles and resonant buzzes are thus prevented, particularly when the speaker is not rotated.

The small thickness of the rods makes them acoustically transparent whereby buffeting sounds are eliminated.

Figure 6:
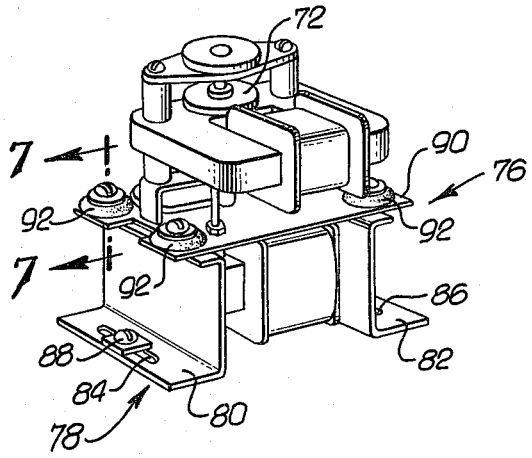
FIG. 6 is an enlarged pictorial view of the motor and mounting bracket.

In order to rotate the rotor, a pulley 70 is provided (FIG. 4) that is mounted on the shaft between the rotor 10 and the panel 12. The pulley is apertured in order to make it as acoustically transparent as possible. It is coupled to the rotor by the aid of a resilient strap (not shown) of the type shown and described in the Schwendener patent identified above. The rotor pulley 70 is coupled to a drive pulley of a motor 72 (FIGS. 2 and 6) by the aid of a pulley belt 74. The motor 72 is mounted on the panel 12 alongside the rotor 10 by the aid of a two part bracket 76.

Figure 7:
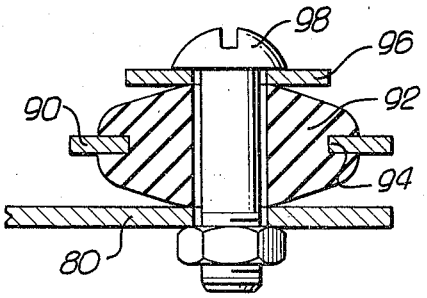
FIG. 7 is a sectional view taken along a plane corresponding to line 7—7 of FIG. 6.

The two parts of the bracket are acoutically isolated, one of the parts mounting the motor and the other of the parts being adjustably mounted on the panel independently of the acoustic isolation means. One of the bracket parts 78 comprises a pair of parallel channels 80 and 82 extending generally radially of the rotor axis for movement inwardly and outwardly thereof for adjustment of pulley tension. For this purpose, the channel sides in engagement with the panel 12 have slots 84 and 86 for cooperation with clamping screws 88. The second bracket part is a plate 90 that bridges the tops of the channels 80 and 82. As shown in FIG. 7, the plate 90 has four holes arrayed as a square in which biconical grommets 92 are captured. For this purpose, each grommet has a peripheral mounting groove 94. The bottom tips of the grommets rest upon the top flanges of the channels 80 and 82 and are held in that position by the aid of washers 96 that rest on the upper tips of the grommets and by the aid of screw fasteners 98. The screw fasteners include screws threaded through the washers 96, grommet 92 and top flanges of the channels 80 and 82. The motor 72 is directly mounted on the plate 90 so that the driving pulley is suitably accessible.

By virtue of the two part bracket, acoustic isolation is provided between the motor and the panel while a simple belt tension adjustment means is provided. In normal operation, the noise circuit between the motor and the panel 12 includes only very small areas at the soft upper tips of the biconical washers. The acoustic impedence is large. Nevertheless the biconical washers provide effective shock mounting. Thus as the grommets flatten under shock load, the compressive force increases approximately as the square of displacement rather than merely linearly. This occurs due to the conical configuration of the grommets. The grommets are effective for both noise isolation as well as for extreme shock loads.

Figure 3:
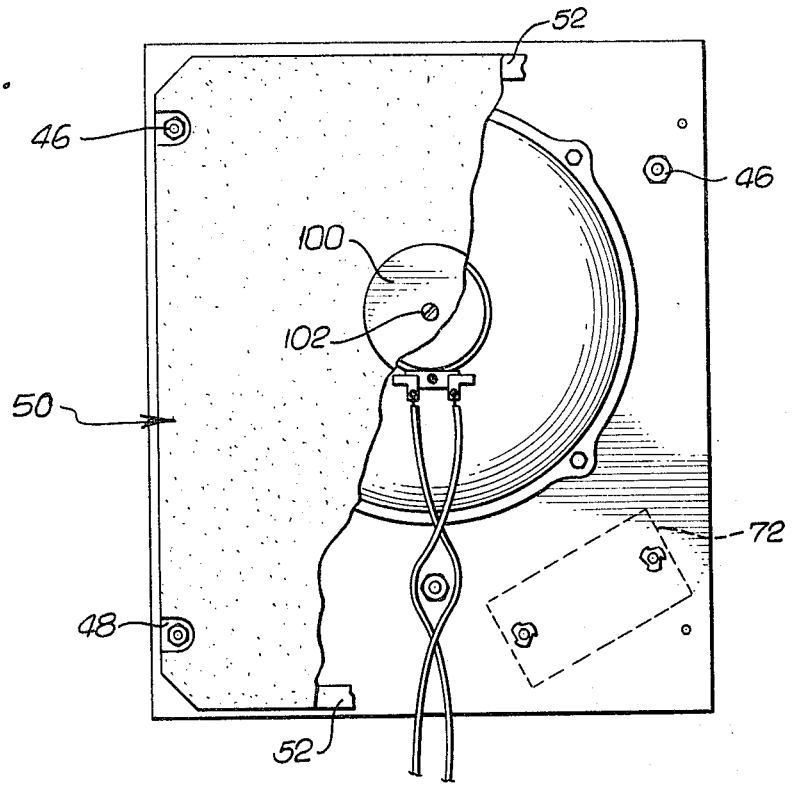
FIG. 3 is a plan view from the speaker side, a portion of the enclosure cap being broken away.
Figure 4:
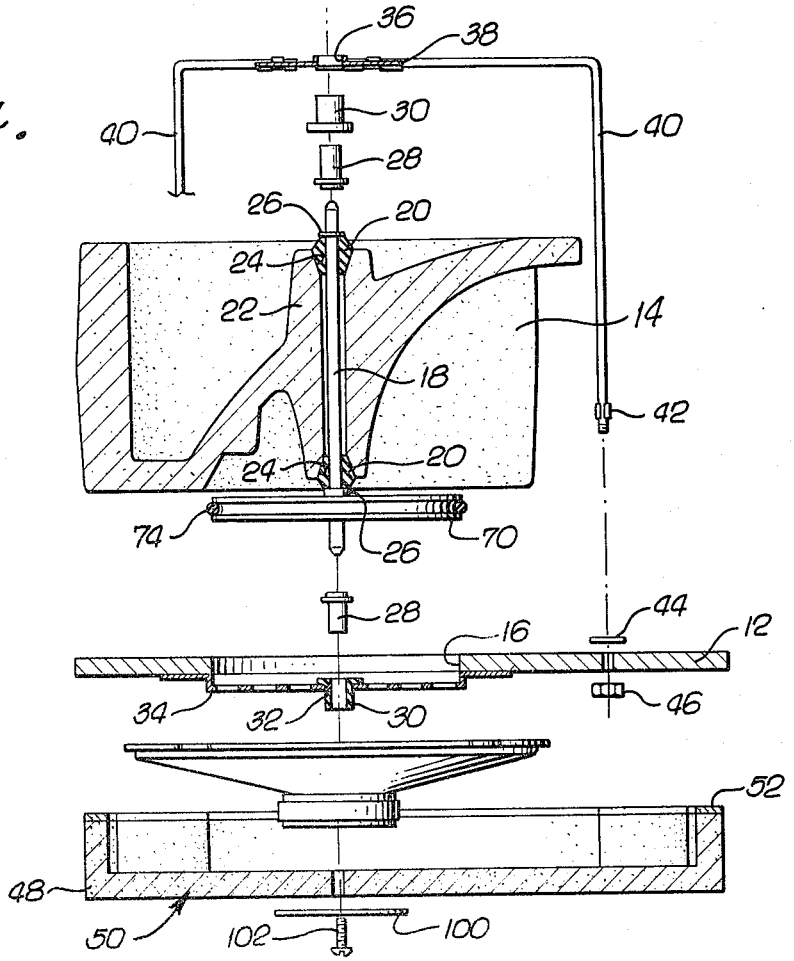
FIG. 4 is a diagrammatic view showing the axial assembly of the shaft, rotor and speaker cap.

As shown in FIGS. 3 and 4, the speaker is enclosed by a molded expanded polystyrene cover 50. The cover, although extremely light weight, is inhibited from vibrating and from reradiating sound by virtue of its being stressed. This is achieved by a stress plate 100 that overlies a substantial area of the cover behind the speaker magnet. A draw screw 102 that attaches to a screw hole in the rear of the speaker magnet imposes a compressive force on the cover so that it acts as a substantially solid, massive body that absorbs back radiations. Dilution of the tremolo effect by back radiation is avoided by means normally considered unsuitable for the purpose. The soft fibrous or paper like gasket 52 not only provides a seal, but also prevents vibrations between imperfectly fitting parts.

In an organization where an effective back enclosure is provided by the particular console structure, the back cover may be deleted. In that case, a soft multilayer paper insulation can be stapled over the speaker for optimum results.

DESCRIPTION OF ALTERNATE EMBODIMENT

Figure 8:
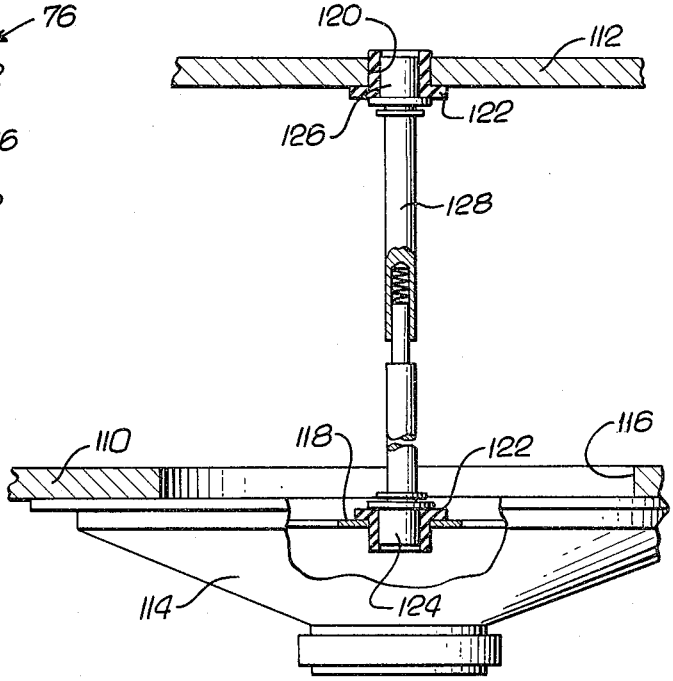
FIG. 8 is a fragmented axial sectional view of a modified shaft assembly for use in mounting a pulsato rotor between two fixed panels.

In the form of the invention illustrated in FIG. 8, the pulsato rotor is installed between fixed panels 110 and 112 of a free standing speaker enclosure. One of the panels 110 mounts a speaker 114 about an opening 116. A bracket 118 like the bracket 34 is mounted across the opening. The opposite panel 112 simply has a hole 120 for insertion of a bearing grommet 122.

In order to generate end thrust on the bearings 124 and 126, the shaft 128 includes two hollow telescoping parts with a coil spring interposed therebetween. The requisite end thrust is thereby provided in a manner equivalent to that provided by the spring action of the spider legs of the previous form. Additionally, the spring serves to compensate for slight deviations in the spacing between the panels.

Intending to claim all novel, useful and unobvious features shown or described, we make the following claims:

1. In musical apparatus cooperable with a speaker:
(a) a rotor;
(b) a shaft mounting said rotor for rotation about an axis;
(c) said rotor having an angled sound channel with a throat at one axial end cooperable with a speaker, and having a substantially radially opening mouth for producing a rotating sound radiation pattern upon rotation of said rotor;
(d) a pair of thrust bearings for the ends of said shaft;
(e) spring bias means imposing a force between said shaft ends and said bearings whereby spurious vibrations and other noises at the junction of said bearings and said shaft ends are eliminated;
(f) said shaft comprising a plurality of telescopic elements;
(g) said spring means being accommodated between said telescopic elements and urging said shaft elements into engagement with said thrust bearings.

2. The combination as set forth in claim 1 together with a pair of spaced panels for mounting said thrust bearings respectively, said telescopic elements accommodating dimensional tolerances of the spacing between said panels as well as eliminating said spurious vibrations and noises.

3. In musical apparatus cooperable with a speaker:
(a) a light weight molded rotor, said rotor having a central aperture for passage of a shaft as well as having outwardly opening tapered recessed at the ends of said aperture;
(b) said rotor having an angled sound channel with a throat at one axial end cooperable with a speaker, and having a substantially radially opening mouth for producing a rotating sound radiation pattern upon rotation of said rotor;
(c) a first pair of rubber-like tapered grommets carried by the shaft and fitted in said tapered recesses at opposite ends of the rotor in the absence of wedging forces, said grommets being cemented in said tapered recesses;
(d) means for rotating said rotor independently of said grommets and said shaft whereby said shaft follows the rotary movement of said rotor;
(e) a pair of cup shaped thrust bearings for the shaft ends; and
(f) a second pair of rubber-like grommets supporting said cup bearings and cooperating with said first pair of grommets to provide noise suppression as well as shock mounting of said rotor.

4. The combination as set forth in claim 3 together with spring bias means imposing a force between said shaft ends and said thrust bearings whereby spurious vibrations and other noises at the junction of said bearings and said shaft ends are eliminated.

5. The combination as set forth in claim 4 together with a common panel for mounting the rotor and the speaker on opposite sides, said spring bias means comprising a plurality of angled spring rods mounted on the panel and together surrounding the rotor, there being hub means mounted on the converging distal ends of said rods and providing a hole for receiving one of said second pair of grommets, said hub means transmitting said spring bias to said shaft.

6. The combination as set forth in claim 5 in which said panel is apertured to provide communication between said speaker and said rotor throat, there being a bracket extending across said opening and having a hole for receiving the other of said second pair of grommets.

7. The combination as set forth in claim 4 in which said shaft comprises a plurality of telescopic elements, said spring means being accommodated between said telescopic elements and urging said shaft elements into engagement with said thrust bearings.

8. The combination as set forth in claim 7 together with a pair of spaced panels for mounting said second pair of grommets respectively, said telescopic elements accommodating dimensional tolerances of the spacing between said panels as well as eliminating said spurious vibrations and noises.

9. In a musical accessory apparatus cooperable with a speaker:

(a) a rotor;
(b) a panel having an aperture for mounting a speaker on one side of the panel;
(c) a rotor shaft mounting said rotor for angular movement on the other side of the panel aperture;
(d) said rotor having an angled sound channel with a throat at one axial end registrable with said speaker and having a substantially radially opening mouth at the other end for producing a rotating sound radiation pattern upon rotation of said rotor;
(e) a pair of bearing cups for the shaft ends respectively;
(f) a bracket extending across said aperture and having a mounting hole for receiving one of said bearing cups at the location of the center of said aperture;
(g) at least three angled rods each having first proximal ends attached to the mounting panel in angularly spaced relationship about said panel aperture to surround the rotor and each having second distal ends substantially converging at a place spaced from said mounting panel to form a cage for said rotor; and
(h) a separate bearing hub carried at the converging distal ends of said angled rods, said hub having a mounting hole receiving the other of said bearing cups.

10. The combination as set forth in claim 9 in which said rods are sufficiently thin as to be acoustically transparent whereby fluttering and buffeting are substantially eliminated as the sound radition patter sweeps past said rods.

11. The combination as set forth in claim 9 in which said rods resiliently resist a change in the angularity thereof, said bearing cups being spaced apart by said rotor shaft an amount sufficient to build a spring force in said rods whereby an axial biasing force is imposed between said shaft ends and said bearings to eliminate spurious vibrations and noises.

12. The combination as set forth in claim 9 in which the distal ends of said rods terminate adjacent, but correspondingly skew to, the shaft axis, said bearing hub being in the form of a plate stamped to provide sets of opposed knuckles for respectively receiving the ends of said rods.

13. The combination as set forth in claim 12 in which each of said rods has a flattened section adjacent its end to provide a twist lock with the knuckles sufficiently tight to be noise free.

14. The combination as set forth in claim 13 in which each of said sets of knuckles extends inwardly from an outer edge of the hub plate and terminating at a hole the remote edge of which services as a placement stop for the end of the corresponding rod.

15. The combination as set forth in claim 14 in which said rods are symmetrical about a central bend, each of the ends of the rods having a flattened section.

16. In a musical accessory apparatus cooperable with a speaker:

(a) a rotor;
(b) a panel having an aperture for mounting a speaker on one side of the panel;
(c) a speaker mounted at said panel aperture, said speaker having a magnet;
(d) a rotor shaft mounting said rotor for angular movement on the other side of said panel aperture;
(e) said rotor having an angled sound channel with a throat at one axial end registrable with said speaker and having a radially opening mouth at the other end for producing a rotating sound radiation pattern upon rotation of said rotor;
(f) bearing means for supporting said shaft for rotation;
(g) bracket means for said bearing means and mounted on said panel, one of the bracket means extending across said panel aperture and the other of said bracket means projecting from said panel and extending to the outboard end of said rotor shaft;
(h) a back enclosure for said speaker made of material having the light weight characteristics of molded expanded polystyrene;
(i) means mounting said back enclosure on the panel to surround said speaker; and
(j) clamping means operative between the magnet and the back of said enclosure for compressing said enclosure to impart thereto characteristics of a heavy vibration resistant material.

17. The combination as set forth in claim 16 together with a soft compressible paper like gasket between the enclosure and said panel.

18. In a musical accessory apparatus cooperable with a speaker:

(a) a rotor having a sound channel;
(b) a panel having an aperture for mounting a speaker on one side thereof;
(c) a rotor shaft mounting said rotor for angular movement on the other side of said aperture with said sound channel in registry with said aperture;
(d) a pulley carried by said shaft and located adjacent said panel opening;
(e) a coupling between the pulley and said rotor for rotation thereby;
(f) a drive motor having a pulley shaft;
(g) a pulley belt between the pulley shaft and said pulley;
(h) a two part bracket mounting said drive motor or said panel, said drive motor being mounted on one of said parts;
(i) means adjustably mounting the first of said bracket parts on said panel for movement radially of said rotor axis for adjustment of the tension of said pulley belt;
(j) the second of said bracket parts being directly attached to said motor;
(k) one of said bracket parts having a plurality of circular openings;
(l) a corresponding plurality of centrally apertured biconical mounting grommets made of resilient rubber-like material having acoustic damping characteristics, each mounting grommets having a peripheral groove fitting the edges of companion circular openings whereby said grommets are peripherally suspended;

(m) a plurality of posts attached to the other of said bracket parts and respectively extending through the mounting; and (n) a plurality of posts attached to the other of said bracket parts, each of the posts extending through a corresponding grommet to capture the grommet at the opposite apex regions thereof between the proximal and distal ends of the corresponding post whereby the said bracket parts are connected with limited contact area though the apex regions thereof whereby, under normal operating conditions, the acoustic path resistance between the parts is maximized while stand by shock support is provided.

* * * * *